US005931450A

United States Patent [19]

Yoder

[11] Patent Number: 5,931,450

[45] **Date of Patent: *Aug. 3, 1999**

[54] MODULAR FENCING SYSTEM

[75] Inventor: Dennis G. Yoder, Nappannee, Ind.

[73] Assignee: Royal Crown Limited, Milford, Ind.

[ * ] Notice: This patent is subject to a terminal disclaimer.

[21] Appl. No.: 08/901,011

[22] Filed: Jul. 28, 1997

Related U.S. Application Data

[63] Continuation of application No. 08/415,536, Apr. 3, 1995, Pat. No. 5,651,534.

[51] Int. Cl.[6] ..... E04H 17/14

[52] U.S. Cl. ..... 256/66; 256/65; 256/59; 256/19

[58] Field of Search ..... 256/19, 65, 66, 256/59, 50, 51, 24, 1; 52/155, 156

[56] References Cited

U.S. PATENT DOCUMENTS

| | | | |
|---|---|---|---|
| 3,822,053 | 7/1974 | Daily | 256/65 X |
| 3,875,699 | 4/1975 | Lamarre | 256/19 X |
| 3,955,801 | 5/1976 | Soriero, Jr. | 256/65 |
| 3,957,250 | 5/1976 | Murphy | 256/19 |
| 4,007,919 | 2/1977 | Totten | 256/59 |
| 4,429,849 | 2/1984 | Maier | 52/155 X |
| 4,540,160 | 9/1985 | Zanavich et al. | 256/66 X |
| 4,691,897 | 9/1987 | Frush | 256/65 |
| 4,702,459 | 10/1987 | Moschner | 256/19 |
| 4,722,514 | 2/1988 | Pettit | 256/19 X |
| 4,958,807 | 9/1990 | Wylie | 256/59 X |
| 5,255,897 | 10/1993 | Pepper | 256/65 X |
| 5,651,534 | 7/1997 | Yoder | 256/66 |

*Primary Examiner*—Harry C. Kim
*Attorney, Agent, or Firm*—Barnes & Thornburg

[57] ABSTRACT

A modular fencing system including posts that have a generally tubular body. At least one opening is disposed in a side wall of said post, with a rail being able to be received in the opening of the post. A longitudinal reinforcing wall is disposed in the post next to the opening for reinforcing the post at least in the area of the opening. The post is adapted to receive a plurality of support systems for temporary, semi-permanent or permanent installations.

22 Claims, 9 Drawing Sheets

MODULAR FENCING SYSTEM

This application is a continuation, of application Ser. No. 08/415.536, filed Apr. 3, 1995, now U.S. Pat. No. 5,651,524.

BACKGROUND OF THE INVENTION

1. Field of the Invention

The present invention relates to a modular fencing system which may be used in a wide variety of applications. According to the preferred embodiment, the present invention relates to a modular fencing system which is of enhanced strength and function, able to be adapted to temporary and permanent installations, and which is aesthetically pleasing in configuration.

2. Description of the Prior Art

Modular fencing systems are known in the art and typically include a plurality of rails as well as a plurality of posts which are able to engage each of the rails. Modular fencing system may be used to provide a confined area for horses or other animals, or may also be used to provide a barrier to guide the movement of individuals during public or private events. In addition, the modular fencing systems may be oriented in many different configurations and are generally mounted permanently in either gravel or in concrete. One particular type of modular fencing system is currently available under the trade name Triple Crown Fence™, manufactured by Chore-Time/Brock of Milford, Ind. In addition, U.S. Pat. No. 4,691,897, which is hereby incorporated by reference, also discloses information relating to a modular fencing system.

Modular fencing systems are typically made from an extruded plastic material such as polyvinyl chloride. Modular fencing systems made from such materials are typically low maintenance and have long-term durability which make such fencing systems a relatively attractive alternative to wood fencing systems. In addition, the natural resilience of such extruded plastic materials provides elastic deformation of the components of the modular fencing system which permits such fencing systems to absorb impact without breaking. These materials are also generally non-toxic and therefore often safe for animals which may attempt to eat the components of a modular fencing system. Finally, the materials from which such modular fencing systems are made are typically recyclable and therefore are environmentally friendly. These advantages of modular fencing systems make such systems particularly attractive for ornamental purposes, both in urban and rural areas.

While such fencing systems are currently well suited for their intended uses, they are nevertheless susceptible to certain improvements. For example, for a horse corral, one may select a modular fencing system which includes posts having rectangular cross-sections. However, the corners which are located on such posts can create an objectionable obstruction to the foot or knee of a rider. In addition, because modular fencing systems have to be relatively strong to withstand the lateral loading of animals which often lean against the posts and rails, the posts and rails generally have to have sufficiently thick walls to withstand such loading. This is particularly important with posts and rails having round cross-sections, in that a relatively large circumferential portion of the cross-section of the post has to be removed to form the aperture for receiving the rail. Finally, such modular fencing systems did not generally have a mechanism by which the fencing system could be moved relatively quickly between various locations so as to rapidly change the configuration of the fencing system.

SUMMARY OF THE INVENTION

It is an object of this invention to provide a modular fencing system that includes posts which are relatively strong.

It is also an object of the present invention to provide a modular fencing system that can be used for temporary, semi-permanent, or permanent installations.

A further object of the present invention is to provide a modular fencing system that can be easily assembled in one location and then easily disassembled for reinstallation in a new location.

Another object of the present invention is to provide a modular fencing system in which the posts of the fencing system have reinforcing members disposed in their interior.

Another object of one embodiment of the present invention is to provide a post for a modular fencing system which has a cross-section in the shape of a rounded-square.

These and other objects of the present invention are achieved by providing a modular fencing system that includes a post which has longitudinal reinforcing walls located in the interior of the post. The reinforcing walls provide an increased resistance to bending upon lateral loading as well as provide means for temporary or semi-permanently mounting of the post. In a preferred embodiment, the posts of the modular fencing system according to the present invention include at least two longitudinally extending reinforcing walls which are located on opposite sides of an opening in the post which is used for receiving the rail of the fence.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiment of the present invention is merely exemplary in nature and is in no way intended to limit the invention or its application or uses.

Figure 1:
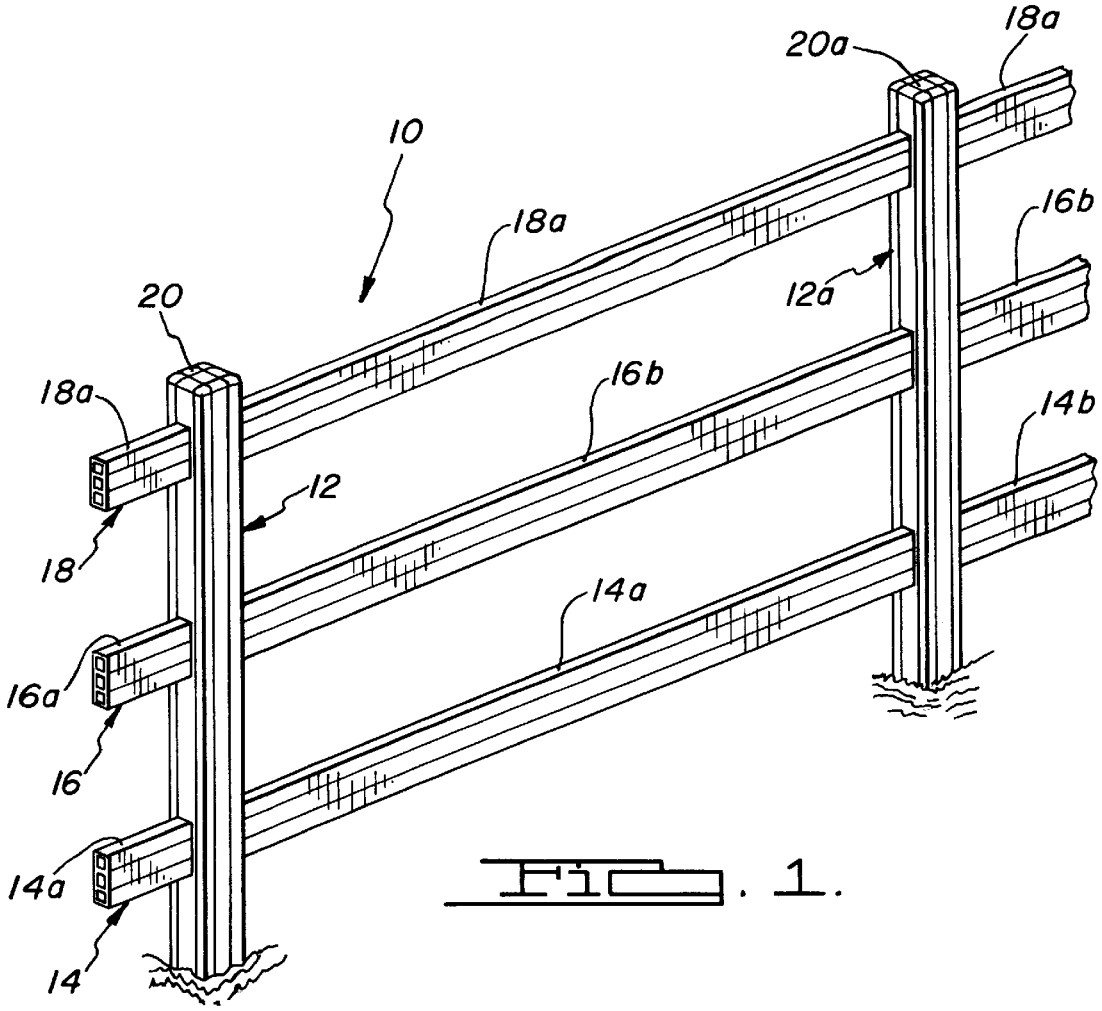
FIG. 1 is an elevational view in perspective showing one embodiment of the modular fencing system according to a preferred embodiment of the present invention.

Referring now to FIG. 1, modular fencing system 10 according to the preferred embodiment of the preferred invention is shown. The modular fencing system 10 may be used in a wide variety of applications, including defining an enclosed area for animals as well as providing a barrier for guiding individuals in a particular direction. The modular fencing system 10 is preferably made from an extruded plastic material such as polyvinyl chloride or an extruded metal such as aluminum. It will be appreciated that other types of manufacturing techniques in addition to extrusion may be used and that the modular fencing system may also be made from other types of materials.

The modular fencing system 10 according to the present invention includes a plurality of hollow extruded posts 12 and 12*a* as well as a number of hollow extruded fence rails. Each of the posts 12 and 12*a* has a plurality of spaced openings along its length which are operable to receive the rails. For the posts 12 and 12*a* shown in FIG. 1 which occupy interior positions of the fence (hereinafter "in-line posts"), a pair of openings are located in opposed walls of the posts 12 and 12*a* at selected locations along the length of the post. Accordingly, paired openings on the opposite sides of the posts 12 and 12*a* are horizontally aligned, which horizontally aligns the rails of the modular fencing system 10.

Figure 14:
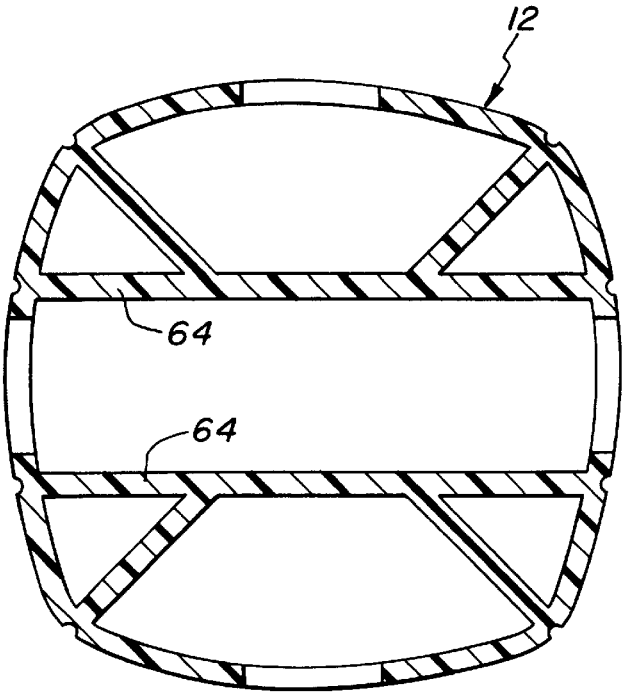
FIG. 14 is a transverse cross-sectional view showing a single functional post of this invention, which can be used as an alternative to the post shown in FIG. 3.
Figure 15:
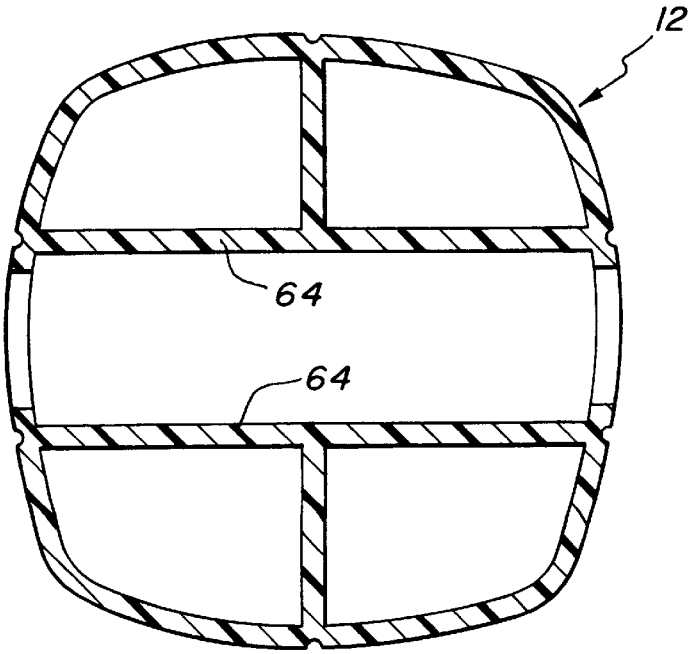
FIG. 15 is a transverse cross-sectional view showing a variation of the post shown in FIG. 14 according to another embodiment of the present invention.

While the modular fencing system 10 illustrated in FIG. 1 shows only two posts 12 and 12*a,* it is to be understood that the modular fencing system 10 will typically include many additional posts. In addition, all the posts of the modular fencing system 10 may have generally the same internal cross-section. However, various alternative embodiments of the posts can be concurrently used in the modular fencing system 10. For example, the posts shown in FIGS. 2–3, 7, 12–13 and 16–18 can be used for in-line applications, as well as for posts located at the end of a fence (hereinafter "end posts") and at corner locations along the fence (hereinafter "corner posts"). The posts of FIGS. 14–15 are primarily intended for in-line applications but could be used for end posts as well.

The modular fencing system 10 may be installed in a variety of ways depending on the particular situation. For example, the posts 12 and 12*a* of the modular fencing system 10 may be secured to the ground by embedding the posts 12 and 12*a* in cement. In addition, the posts 12 and 12*a* of the modular system 10 may also be installed by simply embedding the posts 12 and 12*a* in the ground. Furthermore, the modular fencing system 10 may be secured by means of stakes which are embedded in the ground as will be discussed below. Because of the large number of methods by which the modular fencing system 10 may be secured to the ground, only some of the methods will be presented below. It is to be understood, however, that any suitable method for securing the modular fencing system 10 to the ground may be used.

In the embodiment shown in FIG. 1, the modular fencing system 10 has three levels of rails, including the lower rail 14, middle rail 16 and top rail 18. Each of the rails 14–18 are formed of rail sections of a suitable length. In this regard, the rail 14 is shown to include rail sections 14*a* and 14*b,* while the rail 16 is formed by rail sections 16*a* and 16*b.* Finally, the rail 18 is formed from the rail section 18*a.* All the rail sections of the modular fencing system 10 are identical in cross-section and length but terminate within different posts than those of the other levels. In this regard, the lower rail section 14*a* passes through the opposed openings in the post 12. In addition, the opposed ends of the lower rail sections 14*a* and 14*b* are nested within the opposed openings in the post 12*a.* The middle rail section 16*b* passes through the opposed openings in the post 12*a,* while the opposed ends of middle rail sections 16*a* and 16*b* are nested within the post 12. Finally, the top rail section 18*a* passes through openings in each of the posts 12 and 12*a.* By staggering the location of the ends of the rail sections 14*a,* 14*b,* 16*a,* 16*b* and 18*a,* the strength of the modular fencing system 10 is improved.

In addition, the modular fencing system 10 may have a greater or lesser number of levels of rails than shown in the drawing, depending on the desired height of the modular fencing system 10. In addition, while the rails of the modular fencing system 10 can have any transverse cross-sectional configuration, the rails are preferably rectangular in transverse cross-sectional configuration. In addition, each of the rail sections 14*a,* 14*b,* 16*a,* 16*b,* and 18*a* includes two internal longitudinal walls which are disposed in parallel planes. The internal walls divide the interior of the rail sections 14*a,* 14*b,* 16*a,* 16*b* and 18*a* into three elongated cavities. The rails of the modular fencing system 10 for rural applications would generally be prepared in 18 foot lengths.

To provide means for releasably securing the rail sections 14*a,* 14*b,* 16*a,* 16*b* and 18 to the posts 12 and 12*a,* a fastener 34 is provided. The fastener 34 is operable to be located within the end of the rail sections 14*a*, 14*b*, 16*a*, 16*b* and 18*a* in such a manner as to be compressed to allow the rail sections 14*a*, 14*b*, 16*a*, 16*b* and 18*a* to enter through the openings in the posts 12 and 12*a* during assembly of the modular fencing system 10, while preventing the unintended removal of the rail sections 14*a*, 14*b*, 16*a*, 16*b* and 18*a* from the posts 12 and 12*a* after the modular fencing system 10 has been assembled. The release for the fastener 34 is preferably accessed from inside the post so as to protect the fastener 34 from unwanted release by animals or persons. The releasable fastener 34 can be that which is disclosed in U.S. Pat. No. 4,691,897, which is incorporated herein by reference. However, any other suitable fastener can be used.

Figure 5:
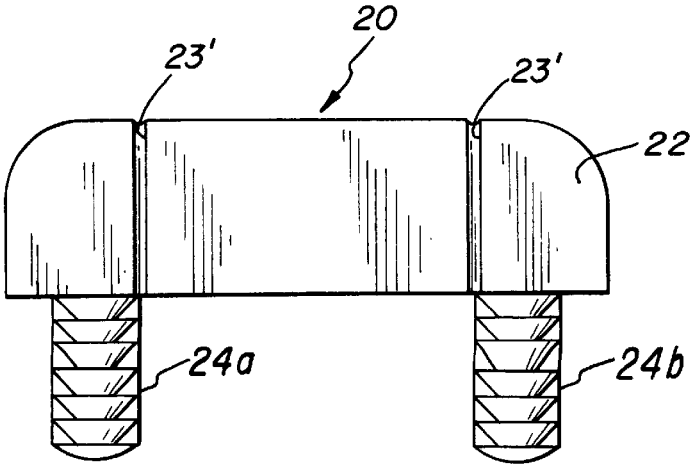
FIG. 5 is an enlarged side elevational view illustrating the post cover shown in FIG. 1 according to a preferred embodiment of the present invention.
Figure 2:
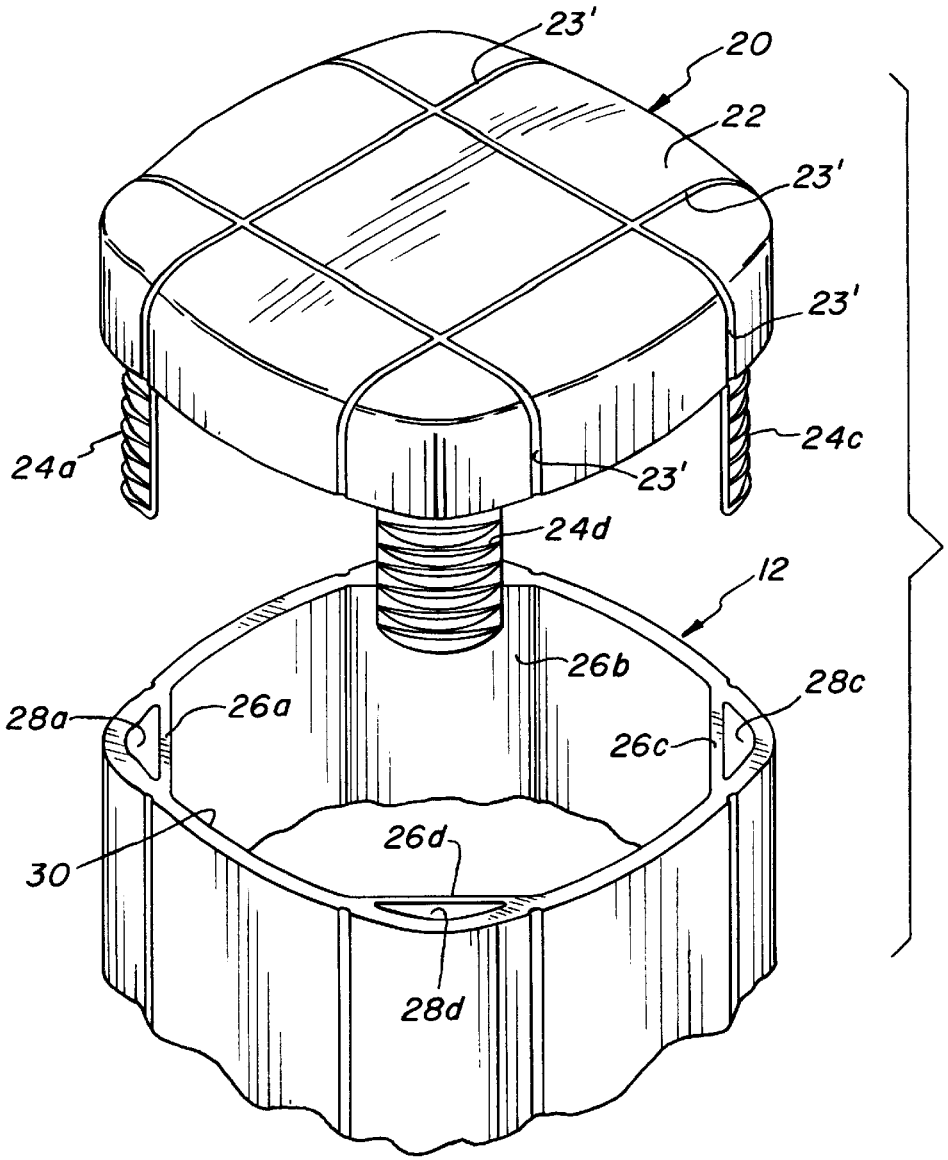
FIG. 2 is an enlarged fragmentary exploded view of the top of a post and the post cover of the modular fencing system shown in FIG. 1 according to a preferred embodiment of the present invention.
Figure 6:
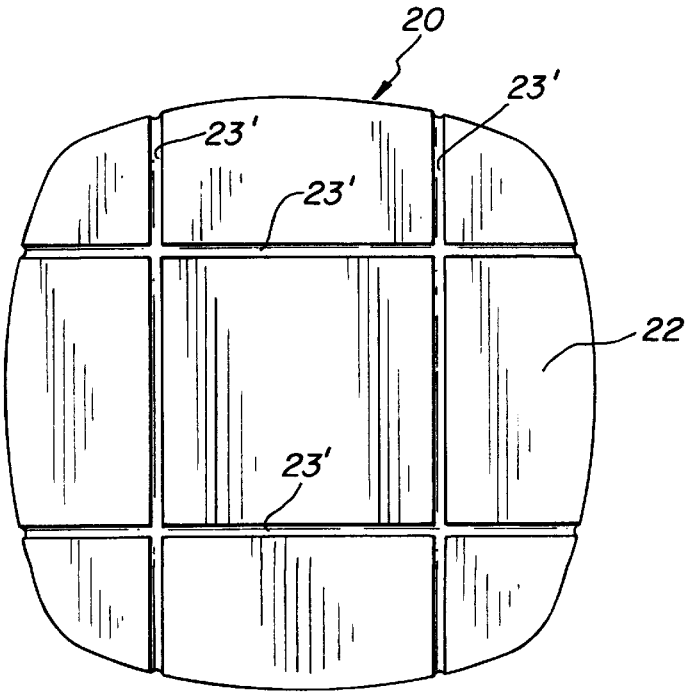
FIG. 6 is a top plan view showing the post cover illustrated in FIG. 5 according to a preferred embodiment of the present invention.

To cover the upper ends of the posts 12 and 12*a*, the posts 12 and 12*a* further include the post covers 20 and 20*a*. As seen more clearly in FIGS. 2, 5 and 6, the post covers 20 and 20*a* each comprise an inverted bowl portion 22 and integral depending leg portions 24*a*–24*d*. The bowl portion 22 has a rounded-square outer periphery with four corners that matches the transverse rounded-square outer periphery of the posts 12 and 12*a*. One of the leg portions 24*a*–24*d* is located at each of the four corners of post covers 20 and 20*a* on the concave side of the rounded-square bowl portion 22. The inwardly facing surfaces of diagonally opposed leg portions 24*a* and 24*c* are flat and parallel, and are angled to match the reinforcing walls within the posts 12 and 12*a* as will be more fully described below. In a similar fashion, the inwardly facing surfaces of diagonally opposed leg portions 24*b* and 24*d* are flat and parallel, and are also angled to match the reinforcing walls within the posts 12 and 12*a* as described below.

Figure 4:
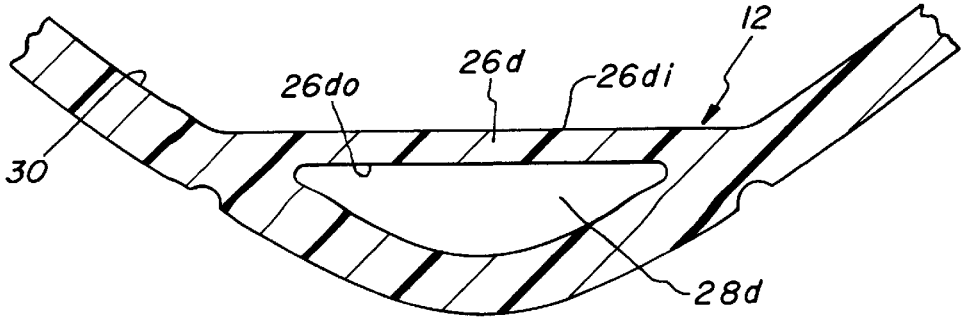
FIG. 4 is an enlarged fragmentary cross-sectional view showing one corner of the post shown in FIG. 3 according to a preferred embodiment of the present invention.
Figure 3:
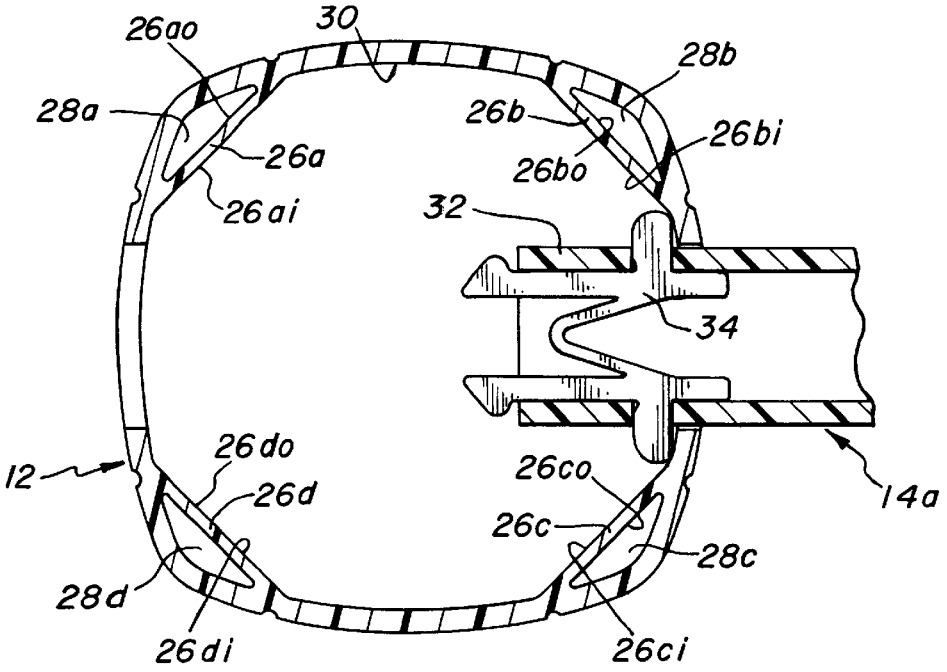
FIG. 3 is an enlarged cross-sectional view of a post and rail shown in FIG. 1 according to a preferred embodiment of the present invention, with the view being transverse to the axis of the post and perpendicular to major faces of the rail.

To provide means for reinforcing the posts 12 and 12*a*, each of the posts 12 and 12*a* have longitudinally extending internal reinforcing walls 26*a*–26*d* as shown in FIGS. 3 and 4. The reinforcing walls 26*a*–26*d* subdivide the interior of each of the posts 12 and 12*a* into a plurality of outer longitudinal recesses 28*a*–28*d* and a central longitudinal cavity 30, all of which extend the length of the post. The reinforcing walls 26*a*–26*d* serve at least two functions. First, the reinforcing walls 26*a*–26*d* serve to increase the ability of the posts 12 and 12*a* to resist lateral loading without failing. In this regard, the reinforcing walls 26*a*–26*d* serve to reinforce the corners of the posts 12 and 12*a* by forming a generally triangular substructure represented by the transverse cross-section of each of the longitudinal recesses 28*a*–28*d*. In addition, the corners of each of the posts 12 and 12*a* are generally arcuate in configuration which provides an additional arching reinforcement for the posts 12 and 12*a*.

In addition, the reinforcing walls 26*a*–26*d* also serve to secure the post covers 20 and 20*a* respectively to the posts 12 and 12*a*. As indicated above, the leg portions 24*a*–24*d* of the post covers 20 and 20*a* are located in the corners of each of the covers 20 and 20*a* which correspond to the locations of the longitudinal recesses 28*a*–28*d* in the posts 12 and 12*a*. In addition, the leg portions 24*a*–24*d* of the post covers 20 and 20*a* are sized to provide frictional engagement with walls defining the longitudinal recesses 28*a*–28*d* so as to retain the post covers 20 and 20*a* on the top ends of the posts 12 and 12*a*. In this regard, the transverse cross-sectional configuration of each of the leg portions 24*a*–24*d* generally conform to the transverse cross-sectional configuration of the longitudinal recesses 28*a*–28*d*, while the disposition of the leg portions 24*a*–24*d* on the post covers 20 and 20*a* correspond to the radial orientation of the longitudinal recesses 28*a*–28*d* of the posts 12 and 12*a*. To enhance the frictional engagement, the outer-facing surfaces of the leg portions 24*a*–24*d* can include special conformations, such as serration or barbs, for engagement with the mating inner walls of the posts 12 and 12*a* that define the longitudinal recesses 28*a*–28*d*. As indicated above, when the post covers 20 and 20*a* are thus affixed to the tops of the posts 12 and 12*a*, the outer periphery of bowl portion 22 is registered with the outer periphery of the posts 12 and 12*a* so that the top end edges of the posts 12 and 12*a* are not exposed.

It should also be noted that shrinkage of the material from which the posts 12 and 12*a* are made may occur during fabrication. If it occurs, the shrinkage can result in unwanted indentations on the external surface of the posts 12 and 12*a*. The indentations will be located on the side wall external surface of the posts 12 and 12*a*, opposite the intersection of internal walls 26*a*–26*d* with the side walls of the post. To avoid the formation of such indentations, a plurality of longitudinal external grooves 23 can be formed on the external surface of the side walls of the posts 12 and 12*a*. The grooves 23 permit such shrinkage to occur without causing unwanted indentations during fabrication. If the grooves 23 are present in the posts 12 and 12*a*, matching grooves 23' may also be placed on the post covers 20 and 20*a* to enhance the appearance of the modular fencing system 10.

The modular fencing system 10 can be used in a wide variety of applications. In this regard, the modular fencing system 10 can be used in applications where it is desirable to have the modular fencing system 10 be temporarily installed so that the modular fencing system 10 can be quickly and easily moved. When such a temporary installation is desired, the modular fencing system 10 can be secured to the ground with stakes in the manner discussed below. Alternatively, the modular fencing system 10 can be used in applications where it is desirable to have the modular fencing system 10 either semi-permanently or permanently installed. The manner in which the modular fencing system 10 can be either semi-permanently or permanently installed will also be discussed below.

Figure 7:
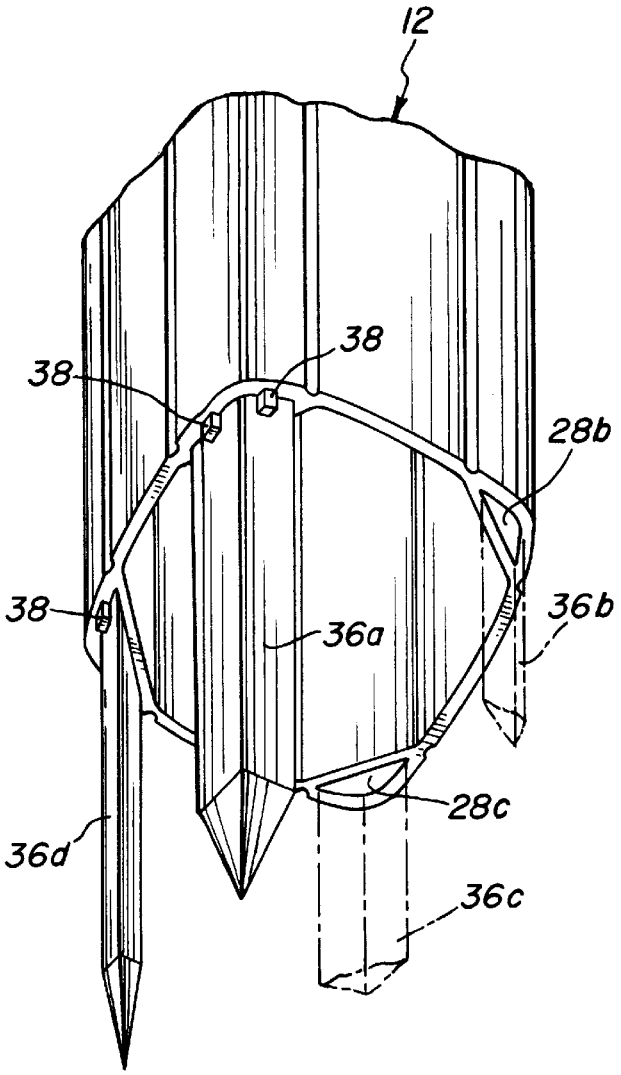
FIG. 7 is an enlarged fragmentary elevational view in perspective showing the bottom end of the post illustrated in FIG. 1 according to a preferred embodiment of the present invention, with mounting stakes nested in longitudinally extending internal cavities located in the corners of the post.

When the modular fencing system 10 is used in applications where it is desirable to have the modular fencing system 10 temporarily installed, the modular fencing system 10 can be used with a plurality of stakes 36*a*–36*d* in the manner shown in FIG. 7. The stakes 36*a*–36*d* are shown as being nested within the lower ends of longitudinal recesses 28*a*–28*d* on the post 12. This nesting is achieved by selecting the transverse cross-section of the stakes 36*a*–36*d*, which are to be inserted within the longitudinal recesses 28*a*–28*d*, be similar but slightly smaller than the transverse cross-section of the longitudinal recesses 28*a*–28*d*.

Each of the stakes 36*a*–36*d* have a projection 38 along their length. The projections 38 provide a shoulder that butts against a lower end edge of the post 12 so that the stakes 36*a*–36*d* do not slide completely into the longitudinal recesses 26*a*–28*d*. It is to be understood that projections 38 could be enlarged to form a flange entirely around each of the stakes 36*a*–36*d*. Such a flange would provide additional ruggedness, which may be desirable if the stakes 36*a*–36*d* are to be driven into ground which is relatively firm. It should be understood that means other than the projection 38 can be used to form an abutment on the stakes 36*a*–36*d* and/or the post 12. For example, a pin (not shown) could be disposed in a transverse hole in each of the stakes 36*a*–36*d*. The pin would have a portion that extends out of the hole to provide an abutting shoulder. This might be a preferred alternative for stakes that are extruded instead of being molded. In addition, transverse pins (not shown) could also be disposed in apertures located within the post 12 to provide an internal abutment for the top ends of each of the stakes 36*a*–36*d*. As will be apparent to those skilled in the art, such pins could be either temporarily or permanently disposed in the stakes 36*a*–36*d* or in the post 12, as may be desired.

Figure 8:
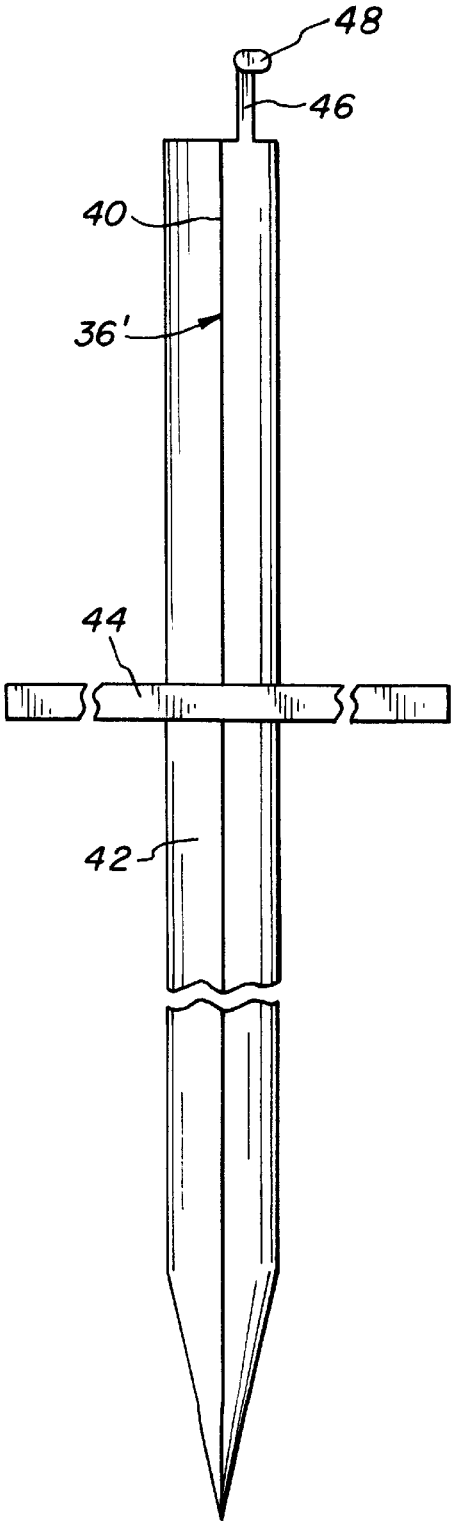
FIG. 8 is an enlarged elevational view showing an alternative embodiment of the mounting stakes shown in FIG. 7 according to a preferred embodiment of the present invention.

The structure of the stakes 36*a*–36*d* may vary depending on a variety of factors, including the intended application for the modular fencing system 10 as well as the consistency of the soil into which the stakes 36*a*–36*d* are to be placed. For moderately soft soil, the stakes 36*a*–36*d* shown in FIG. 7 as well as the stake 36' shown in FIG. 8 may be used. The stake 36' shown in FIG. 8 has an upper end portion 40 that is intended to be received within one of longitudinal recesses 28*a*–28*d* of the posts 12 and 12*a*, and a lower end portion 42 that is intended to be embedded into the ground. Like the upper portion of the stakes 36*a*–36*d*, the upper end portion 40 of the stake 36' has a transverse cross-section similar to, but slightly smaller than, the transverse cross-section of the longitudinal recess 28*a*–28*d* of the post 12. However, stake 36' further includes a flange 44 of a width that is appropriate for the particular type of ground in which stake 36' is to be embedded. The flange 44 serves not only to prevent the stake 36' from being entirely received within the longitudinal recesses 28*a*–28*d*, but also prevents the stake 36' from being entirely embedded in the ground. In addition, if the flange 44 on the stake 36' is made relatively wide, the flange 44 can be used to improve the lateral stability of the stake 36' in relatively soft soil and therefore the lateral stability of the modular fencing system 10.

The stake 36' may have a thin integral appendage 46 upstanding on the upper end of the stake 36' with a projection 48 thereon that can interlock with a corresponding small aperture in the side wall of the posts 12 and 12*a*. Other means could also be provided to lock the stake 36' to the post 12. The lock would be a positive means for preventing the upper portion of the stake 36' from accidentally sliding out of the post 12 before embedding the stake 36' into the ground.

Other forms of stakes and analogous supports for the modular fencing system 10 are also possible, as will hereinafter be explained. For example, a single large stake (not shown) could be used in place of the stakes 36*a*–36*d*. A single large stake would have an upper portion with lateral surfaces that engage interior surfaces of the post 12 that define longitudinal central cavity 30 of the post 12. In this regard, the single large stake could be a solid body having an upper portion that has a transverse cross-section similar to but slightly smaller than the transverse periphery of the central cavity 30 that would receive it. However, the upper portion of the single large stake could have other transverse cross-sectional configurations as well. If so, each one should have an external periphery that fits closely within the central cavity 30 of the post 12 to provide the desired lateral stability. For rather soft soil, a single large stake may have a large circumferential transverse flange, similar to the flange 44 on stake 36' of FIG. 8, could be used.

Figure 10:
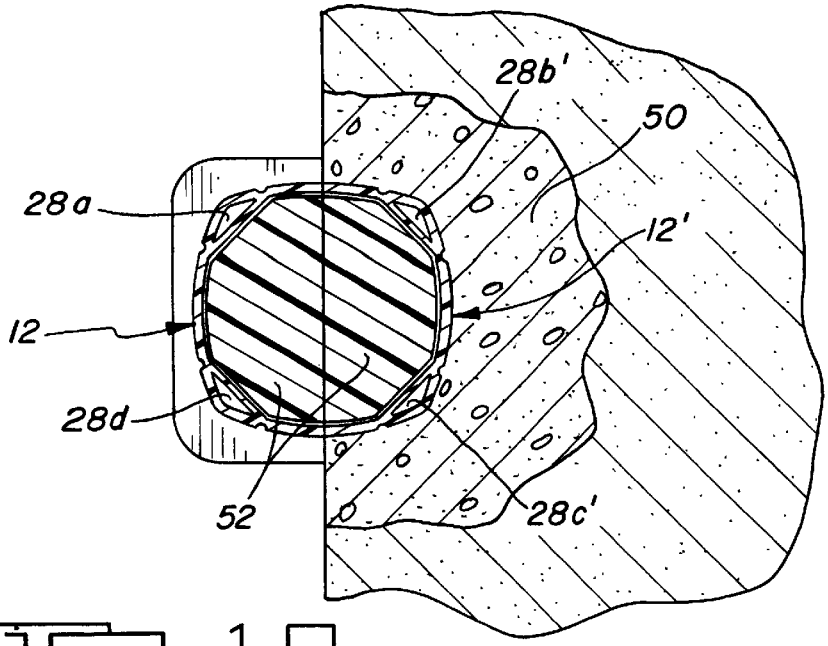
FIG. 10 is a sectional view along the line 10—10 of FIG. 9 according to a preferred embodiment of the present invention.
Figure 9:
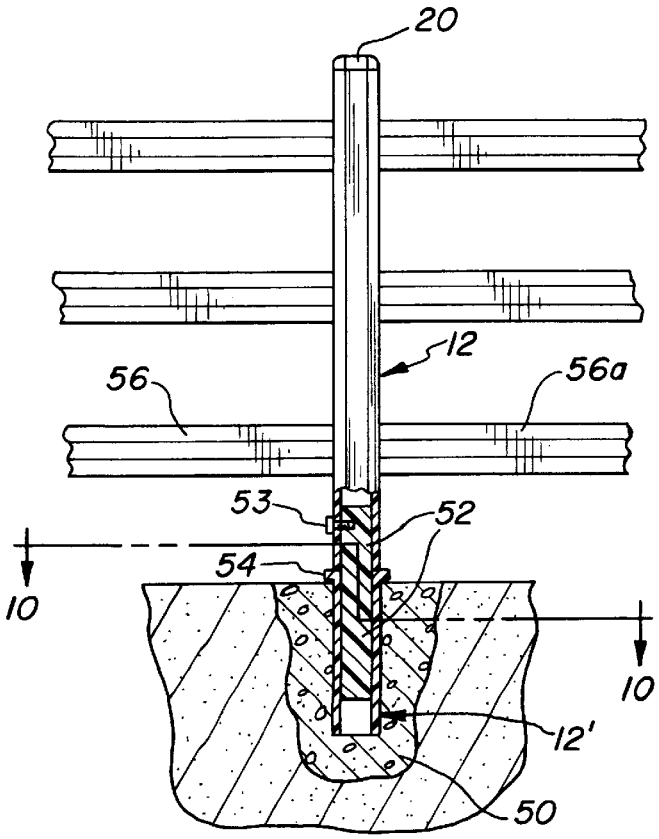
FIG. 9 an elevational view in partial section showing semi-permanent mounting installation of the modular fencing system shown in FIG. 1 according to a preferred embodiment of the present invention.

As discussed above, the modular fencing system 10 can not only be used in temporary installations, but can also be used in semi-permanent installations as well. For example, it may be desirable to use the modular fencing system 10 in a semi-permanent installation when the modular fencing system 10 is used for stock pens which may vary in size according to the number of animals in the stock pen at any given time. One may also want to periodically change the size and/or the shape of an animal pen to suit changing functions of the pen. When it is desirable to use the modular fencing system 10 in a semi-permanent installation, the modular fencing system 10 may be installed in a manner similar to that shown in FIGS. 9 and 10. In this regard, FIGS. 9 and 10 show that the lower portion of the post 12 engages a post extension 12' which is embedded in a concrete footing 50. Disposed between the post 12 and the post extension 12' is a connector member 52. The lower portion of a connector member 52 is nested within the hollow interior of post extension 12'. The lower portion of connector member 52 can have a transverse cross-section similar to, but slightly smaller than, the transverse periphery of the receiving cavity of the in post extension 12'. The connector member 52 includes means for preventing the connector member from being completely received into the central cavity of the post extension 12'. In this example, the means may be a circumferential flange 54 which insures that an upper portion of connector member 52 is left exposed to support the post 12.

The upper portion of connector member 52 is nested within the interior of the lower end of the post 12 to provide support for the post 12. The upper portion of the connector member 52 has a transverse cross-section selected to engage the central cavity 30 in the lower end of the post 12. In this regard, the upper portion of connector member 52 can have a transverse cross-section similar to, but slightly smaller than, the transverse periphery of the central cavity 30 of the post 12. In addition, if post extension 12' has the same transverse cross-section as the post 12, the transverse cross-section of upper and lower portions of connector member 52 can be the same. The upper portion of connector member 52 can be of any length, up to the bottom of the rails 56 and 56*a*, thus providing considerable strength to the upper portion of the post 12 and therefore to the modular fencing system 10. If the upper portion of connector member 52 has a configuration to nest in the outer longitudinal cavities 28*a*–28*d* of the post 12, the upper portion of the connector member 52 could have a longer length without interfering with the internal connectors for rails of the modular fencing system 10.

It should also be mentioned that one may wish to lock connector member 52 to either or both of the post extension 12' and the post 12. Any of a variety of means can be used for this purpose. By way of example and not limitation, a simple lag screw 53 is shown in FIG. 9 for locking the upper portion of the connector member 52 to the post 12. Another means might be preferred if one elects to more fully lock the lower portion of the connector member 52 to the post extension 12'.

As can be seen, the modular fencing system 10 shown in FIGS. 9 and 10 can readily be removed from post extension 12'. The rails 56 and 56*a* would be removed, along with the lag screw 53. Then the post 12 would be lifted up until clear of the upper portion of the connector member 52. The connector member 52 can then pulled up from the post extension 12', and then the post extension 12' preferably capped. The modular fence components, including the connector member 52, would then be transported to a new location (not shown) where a second post extension 12' was previously embedded in a concrete footing. The second post extension 12' is then uncapped, the lower end of the connector member 52 slid down into the second post extension 12', the post 12 mounted on the upper portion of the connector member 52, and the modular fencing system 10 reassembled. It should be recognized that the second post extension 12' need not be identical to the first one. It need only have a longitudinal cavity that nests with the particular connector used. Preferably, the second post extension 12' has a longitudinal cavity that matches the lower end of the same connector member 52 used in the first post extension 12'.

Accordingly, this new and improved modular fencing system 10 can disassembled and moved to a new previously prepared location quite readily, and immediately be reassembled to form a modular fencing system 10 of a different configuration.

Figure 11:
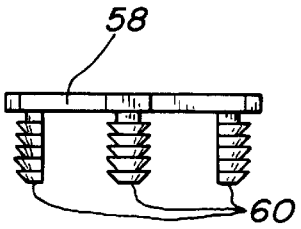
FIG. 11 is a side elevational view showing a closure cap that can be used for the top and/or bottom of the embedded portion of the post shown in FIG. 9 according to a preferred embodiment of the present invention.

The first post extension 12' can be covered with a cap member that is analogous to post covers 20 and 20*a*. Such a cap member is shown in FIG. 11. The cap member 58 includes a flat plate portion with depending legs 60 that are made to nest in corner recesses 28*a*'–28*d'* of the upper end of the post extension 12'. The legs 60 could be identical to legs 24*a*–24*d* of post covers 20 and 20*a*, and thus be identically frictionally retained in recesses 28*a*'–28*d'* at the top end of the post extension 12'. The cap member 58 is disposed at the top of the post extension 12' when the post extension 12' is not in use so as to prevent the post extension 12' from filling with dirt or the like. The cap member 58 could also be used at the bottom of the post extension 12' to prevent concrete from filling the bottom of the post extension 12' when the post extension 12' is initially embedded in the concrete footing 50. Still further, it is recognized that in the alternative, the post covers 20 and 20*a* could also be used for covering the top and bottom of the post extension 12' if a lower profile cap is not needed.

The modular fencing system 10 of this invention can be varied in other ways as well. For example, the transverse outer periphery of the posts 12 and 12*a* is preferably a rounded-square previously described for greatest strength. On the other hand, in certain instances one may prefer that the transverse outer periphery of the posts 12 and 12*a* be round or square. In addition, the outer periphery could also be oval, rectangular, hexagonal, octagonal, etc. Analogously, the improved post strength in this invention is most advantageously used with rails which have a rectangular or at least generally rectangular transverse cross-section. However, improved posts might also be used with rails of other transverse cross-sectional configurations, as for example, round.

Figure 12:
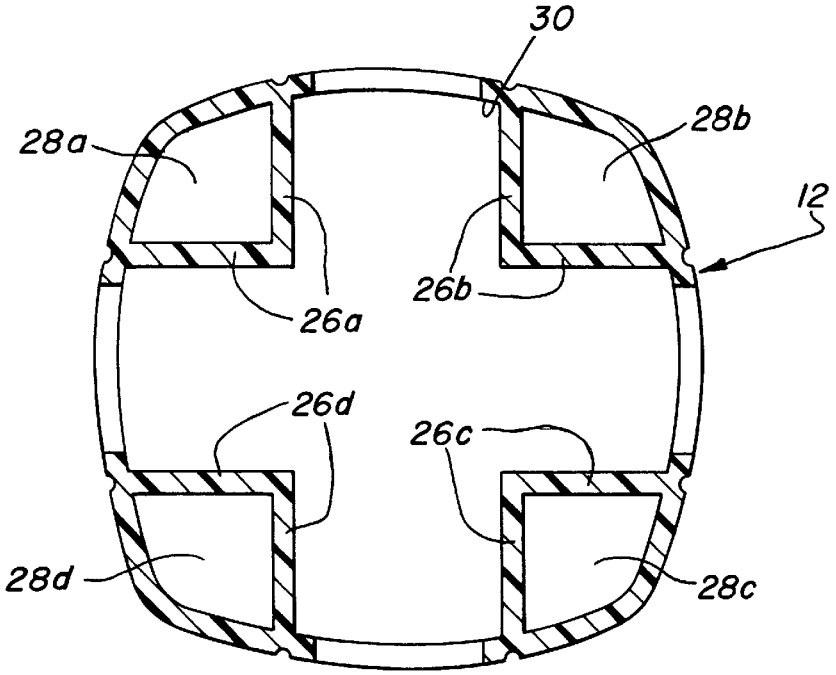
FIG. 12 is a transverse cross-sectional view of a post shown in FIG. 1 having an alternative cross-sectional configuration according to the preferred embodiment of the present invention.
Figure 13:
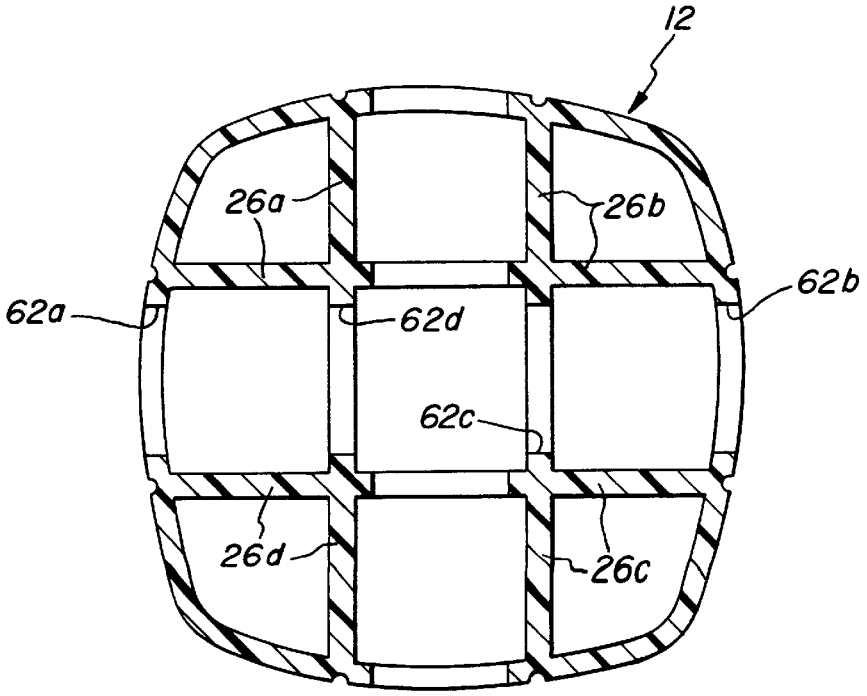
FIG. 13 is a transverse cross-sectional view of the post shown in FIG. 11 according to another embodiment of the present invention.

Still other variations in the posts 12 and 12*a* are possible. The preferred transverse cross-sectional configuration for the internal longitudinal reinforcing walls 26*a*–26*d* in the posts 12 and 12*a* is a straight line, as has already been described herein. However, it is to be understood that the reinforcing walls 26*a*–26*d* can have other transverse cross-sectional configurations. For example, each of the reinforcing walls 26*a*–26*d* need not be transversely straight as shown in FIG. 12 in which they are illustrated as transversely right-angled. It may be preferred that the transverse cross-section of the reinforcing walls 26*a*–26*d* be arcuate or even semi-hexagonal. Each of these variations would effectively increase the cross-sectional area of the recesses of 28*a*–28*d*. This increase in transverse cross-sectional area of the recesses 28*a*–28*d* may be desirable because it would allow an increase in the transverse cross-sectional area of any conformal stakes that would be inserted in the recesses 28*a*–28*d* at the bottom of the post 12 so as to increase the strength of the stake. Also, one or more of the different wall configurations may provide selective manufacturing advantages and/or enhanced resistance to selected types of bending or other loads applied to the post 12. Accordingly, a particular type of transverse wall configuration other than straight may be desired for particular applications.

As mentioned above, FIG. 12 shows internal walls 26*a*–26*d* as each having a transverse cross-section that is in the shape of a right angle. This configuration leaves the center of the post 12 clear free from any obstruction. If the center of the post 12 does not have to be free from obstructions, the walls 26*a*–26*d* in the FIG. 12 embodiment could each be extended across the interior of the post 12 in a manner similar to that shown in FIG. 13 so as to increase the strength of the post 12. However, it should be understood that the construction of the post 12 in FIG. 13 requires twice the number of openings in the walls for receiving the rails. This tends to increase the manufacturing cost of the post 12.

The post 12 according to the embodiments shown in FIGS. 14 and 15 are primarily intended for use as in-line posts or as end posts, and they are not preferably used as corner posts. The post 12 illustrated in FIGS. 14 and 15 show that a variety of transverse configurations for interior reinforcing walls are available that permit the rail to pass through the center of the post 12 without obstruction. In each of FIGS. 14 and 15, the post 12 has two major interior walls 64 that are spaced apart and are parallel. The walls 64 can be additionally reinforced with auxiliary reinforcing walls in the manner shown. The auxiliary reinforcing walls in FIG. 14 allow for a side wall opening in post 12 that is perpendicular to the walls 64. The auxiliary reinforcing walls in FIG. 15 do not. It should also be noted that the wall construction shown in FIG. 15 might permit the post 12 to be used as a corner post, though this would not be particularly convenient. The end of a rail (not shown) could be inserted into the post 12 perpendicular to the walls 64. However, there is not much room within the post 12 for the end of the rail, or means for fastening the rail within the post 12. In the configuration of the post 12 shown in FIG. 15, if an opening was formed for a rail perpendicular to the walls 64, the auxiliary reinforcing wall would have to be cut which reduces the strength of the post 12.

Figure 16:
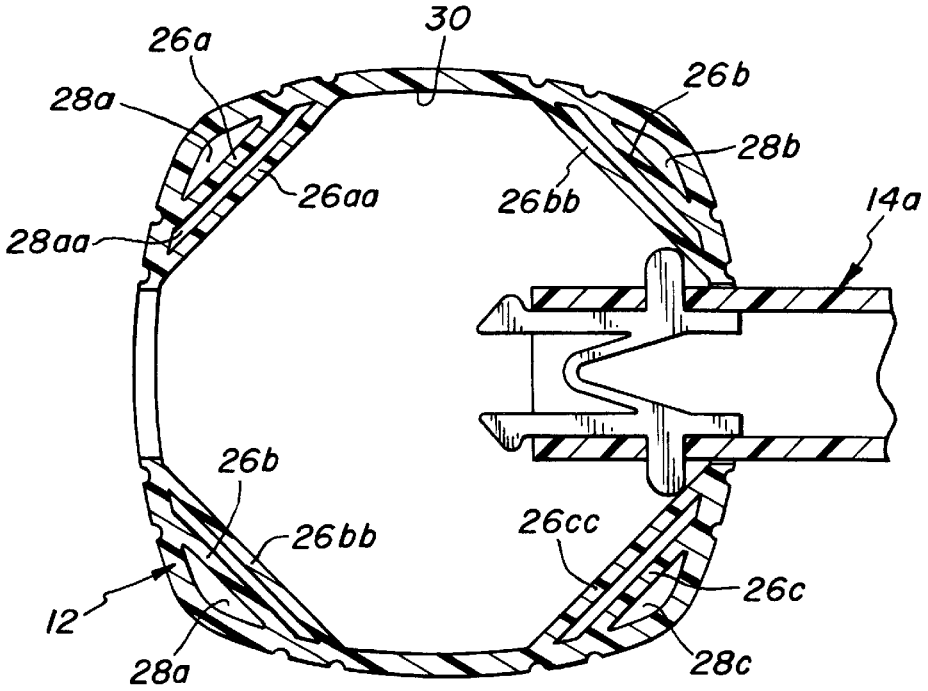
FIG. 16 is a transverse cross-sectional view showing an alternative construction to the post construction shown in FIG. 3 according to another embodiment of the present invention.

As can be seen in FIG. 16, a second set of reinforcing walls 26*aa*–26*dd* is included within the post 12. However, the addition of the second set of reinforcing walls 26*aa*–26*dd* may require the first set of reinforcing walls 26*a*–26*d* to be displaced inwardly. Since using the second set of reinforcing walls 26*aa*–26*dd* tends to make the first set of reinforcing walls 26*a*–26*d* encroach on areas where the side wall openings are to be cut, use of the second set of reinforcing walls 26*a*–26*d* is not ordinarily preferred. Further, the use of a second set of reinforcing walls 26*a*–26*d* tends to increase the thickness of the side walls of the post 12 where the openings are to be formed, which is objectionable. In addition, if one attempts to minimize the encroachment of the walls 26*aa*–26*dd* into the side walls of the post 12, one ends up reducing the cross-sectional area of the recesses 28*a*–28*d*. This may not be objectionable if a single central connector member or stake is used in the central cavity 30 of the post 12, such as in semi-permanent applications, or if the bottom of the post 12 is to be embedded in concrete such as in a permanent installation.

Figure 17:
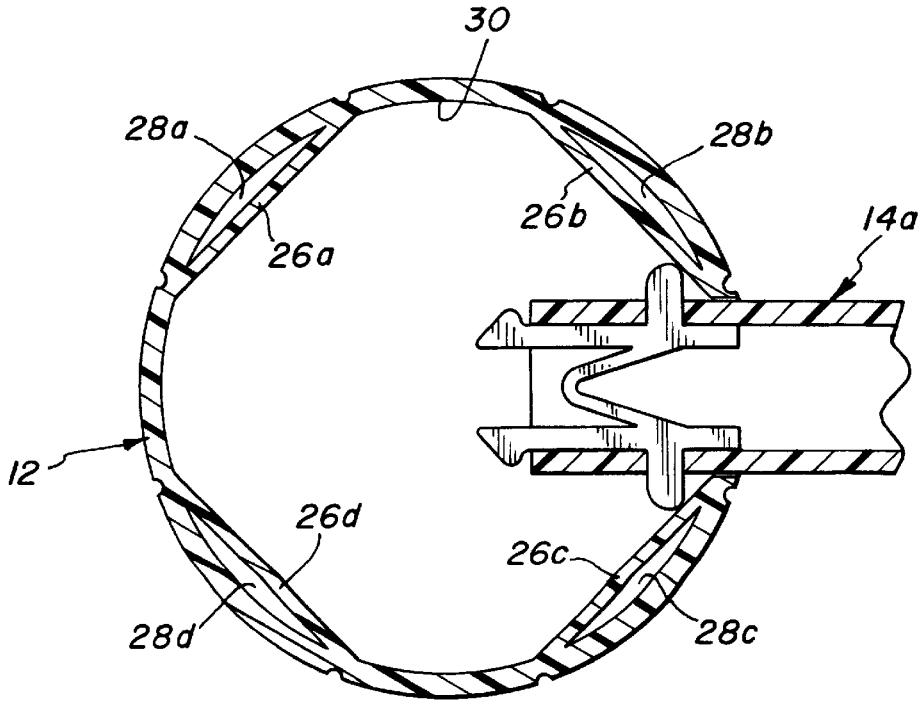
FIG. 17 is a transverse cross-sectional view showing another post according to another embodiment of the present invention, which has a round cross-sectional periphery and linear internal walls such as shown in FIG. 3.
Figure 18:
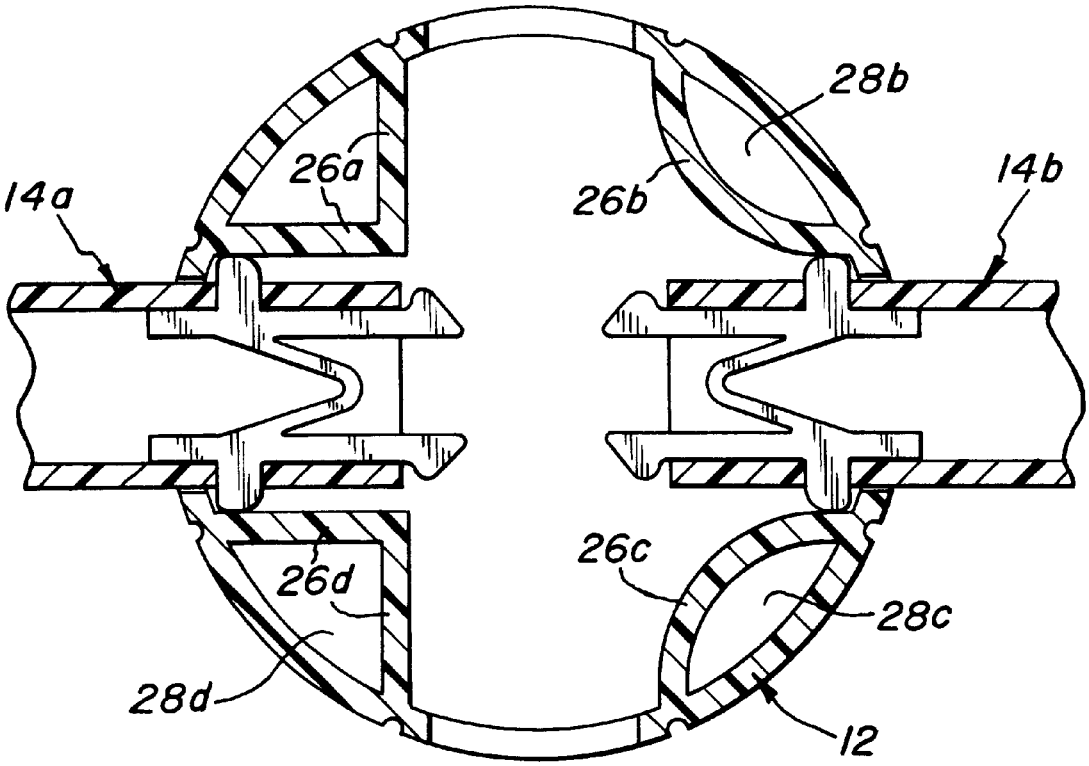
FIG. 18 is a transverse cross-sectional view showing a round tubular post according to another embodiment of the present invention but with internal walls of two different types.

As mentioned above, the post 12 could have a round or polygonal transverse outer periphery. FIGS. 17 and 18 are included to illustrate such a round transverse outer periphery, as well as to illustrate that transversely straight interior reinforcing walls 26*a*–26*d* can be used in a post 12 having a round transverse outer periphery. FIGS. 16 and 17 are also included to show that, if desired, the rail sections 14*a* and 14*b* could be used with a round post that has interior reinforcing walls in accordance with this invention. The rectangular rail sections 14*a* and 14*d* with round posts 12 may not be as aesthetically pleasing as using a round rail section with a round post. However, use of a rectangular rail section with a round post of this invention may allow a round post to be used in applications where it was previously desired but for limitations involving strength.

One can see from FIG. 17 that in a round post, recesses 28*a*–28*d* are quite thin if walls 26*a*–26*d* are straight in transverse extension. This may not be objectionable for some applications, especially where the post 12 is to be embedded in ground or concrete, or where use of a single large mounting stake or other similar support is to be used. If the thin recesses 28*a*–28*d* shown in FIG. 17 are in fact objectionable, a different configuration for interior reinforcing walls 26*a*–26*d* can be used.

FIG. 18 illustrates two such different configurations that can be used for the transversely straight reinforcing walls 26*a*–26*d* of the post 12 shown in FIG. 17. In FIG. 18, the reinforcing walls 26*a* and 26*d* each have a right-angled transverse configuration, analogous to the transverse configuration of the reinforcing walls 26*a*–26*d* in FIG. 12. However, the reinforcing walls 26*b* and 26*c* have an arcuate transverse configuration. Both the angular and arcuate configurations can make the transverse area of recesses 28*a*–28*d* much greater. Accordingly, they may be preferred for posts having a round transverse outer periphery. FIG. 18 also shows that the interior reinforcing walls 26*a*–26*d* do not all have to have the same transverse configuration. For some applications, differences in the transverse configurations of the reinforcing walls 26*a*–26*d* may prove to be desirable.

While the above description constitutes the preferred embodiment of the invention, it will be appreciated that the invention is susceptible to modification, variation, and change without departing from the proper scope or fair meaning of the accompanying claims. For example, the posts 12 may only have openings in their side walls where rails are to be inserted, as this provides the strongest resultant posts. On the other hand, where ultimate strength is not as important, it may be desirable to form openings in the posts to meet all probable applications, and simply put a cap (not shown) over the openings that are not used.

What is claimed is:

1. A fencing system, comprising:

a post;

at least one opening in the post;

at least one rail;

at least one stake;

a reinforcing member connected to the post and extending longitudinally within the post, the stake being operable to be at least partially received between the reinforcing member and the posts at least one groove extending longitudinally along the post and being operable to permit formation of the post without causing indentations to occur on the post; and a post cover, the post cover including a groove intersecting the groove in the post when the post cover engages the post.

2. The fencing system according to claim 1, wherein the post includes a generally tubular body having a transverse cross-section with an outer periphery at least partially defined by a rounded square.

3. The fencing system according to claim 1, wherein the reinforcing member includes a reinforcing wall.

4. The fencing system according to claim 1, wherein the reinforcing member is located at least partially within the post.

5. The fencing system according to claim 1, wherein the reinforcing member is disposed within the post such that the rail can be received in the opening without also providing openings in the reinforcing member.

6. The fencing system according to claim 1, wherein the post includes at least two openings to allow the rail to be passed through the post without obstruction by the-reinforcing member.

7. The fencing system according to claim 1, further including a projection on the stake.

8. A fencing system, comprising:

a post;

at least one opening in the post;

at least one rail;

at least one reinforcing member extending longitudinally along the inside of the post;

at least one groove extending longitudinally along the post; and a post cover including a groove intersecting the groove in the post when the post cover engages the post.

9. The fencing system according to claim 9, wherein at least one reinforcing member has a transverse cross-section that is selected from the group consisting of linear, angular and generally arcuate.

10. The fencing system according to claim 8, wherein the post has a transverse cross-section at least partially defined by a rounded square.

11. The fencing system according to claim 8, wherein at least one reinforcing member extends longitudinally substantially the entire length of the post.

12. The fencing system according to claim 8 wherein, at least one reinforcing member is disposed within the post such that the rail can be received in the opening without also providing openings in the reinforcing member.

13. The fencing system according to claim 8, further comprising at least one stake.

14. The fencing system according to claim 13, wherein the stake is operable to be partially received within the post.

15. A fencing system including a rail and a post, the post comprising:

a generally tubular body having a longitudinal axis and a side wall defining an interior cavity;

at least two reinforcing walls extending substantially the length of the interior cavity, the reinforcing walls extending across the interior cavity so as to divide the interior cavity into at least two first cavity portions that are adjacent to a second central cavity portion;

at least two openings in the side wall of the generally tubular body for receiving the rail, the openings exposing the second cavity portion so as to receive the rail within the second cavity portion; and at least one of the reinforcing walls is disposed between the at least two openings.

16. The fencing system according to claim 15, wherein generally tubular body has a transverse cross-section that resembles a rounded square.

17. The fencing system according to claim 15, wherein:

the generally tubular body has a generally rectangular transverse cross-section that has rounded corners and arcuate side walls;

the generally tubular body has four reinforcing walls whose transverse extension is across the rounded corners so as to divide the interior cavity into four first cavity portions that are nested within an outer periphery of the central second cavity portion, the first cavity portions being substantially equally spaced apart around the axis of the body.

18. The fencing system according to claim 17, wherein:

at least two of the openings are disposed on opposing side walls of the generally tubular body at a given longitudinal location; and two of the reinforcing walls are disposed between each of the openings to allow the rail to be positioned within the generally tubular body by sliding the rail through both of the openings.

19. The fencing system according to claim 15, wherein generally tubular body has a first end, a second end and at least one recess adapted to receive a post cover, the reinforcing walls being adapted to interlock with the post cover.

20. The fencing system according to claim 15, wherein the generally tubular body has at least one recess adapted to receive at least one stake and the reinforcing walls are adapted to interlock with the stake.

21. The fencing system according to claim 15, wherein the reinforcing walls provide a plurality of radially spaced recesses in the interior cavity adapted to receive interlocking portions of a post cover at one end of the tubular body and interlocking portions of a stake at the other end of the tubular body.

22. The fencing system according to claim 15, wherein the reinforcing walls have a transverse cross-section that is selected from the group consisting of linear, angular and generally arcuate.

* * * * *